US007350856B1

(12) United States Patent
Tseng

(10) Patent No.: US 7,350,856 B1
(45) Date of Patent: Apr. 1, 2008

(54) FOLDABLE CHAIR

(76) Inventor: Chun-Hsien Tseng, No. 3, Ting-His-Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 0 days.

(21) Appl. No.: 11/656,702

(22) Filed: Jan. 23, 2007

(51) Int. Cl.
*A47C 4/30* (2006.01)

(52) U.S. Cl. ..... 297/45; 297/44; 297/48

(58) Field of Classification Search ..... 297/45, 297/44, 42, 46, 48, 16.2, 378.1
See application file for complete search history.

(56) References Cited

U.S. PATENT DOCUMENTS 4,801,176 A * 1/1989 Wolberg ..... 297/44
5,429,413 A * 7/1995 Levy et al. ..... 297/45

* cited by examiner

*Primary Examiner*—Milton Nelson, Jr.
(74) *Attorney, Agent, or Firm*—The Webb Law Firm

(57) ABSTRACT

A foldable chair includes a leg unit, a seat unit supported on the leg unit, a pivot unit including two pivot joints secured to the leg unit, and a backrest unit including two opposite backrest rods that are pivoted to the leg unit through the pivot joints, respectively. The backrest unit is rotatable relative to the leg unit between a folded position, in which the backrest unit overlaps with the seat unit, and an extended position, in which the backrest unit stands upright from the seat unit.

4 Claims, 5 Drawing Sheets

FOLDABLE CHAIR

BACKGROUND OF THE INVENTION

1. Field of the Invention

The invention relates to a foldable chair, more particularly to a foldable chair that includes a foldable backrest unit.

2. Description of the Related Art

A conventional foldable chair generally includes a leg unit, a seat unit secured to the leg unit, and a backrest unit extending upwardly from a rear end of the seat unit. Conventional foldable chairs can normally be folded in a manner such that the seat and leg units overlap each other, or in a manner such that left and right parts of the leg unit overlap each other. However, the size of the conventional chair folded in one of the above two manners is still relatively large, thereby making the storage and transportation of the conventional chair inconvenient.

SUMMARY OF THE INVENTION

Therefore, the object of the present invention is to provide a foldable chair that can achieve a relatively small size in a folded state so as to facilitate storage and transportation thereof.

Accordingly, a foldable chair of the present invention comprises a leg unit, a seat unit supported on the leg unit, a pivot unit including two pivot joints secured to the leg unit, and a backrest unit including two opposite backrest rods that are pivoted to the leg unit through the pivot joints, respectively. The backrest unit is rotatable relative to the leg unit between a first folded position, in which the backrest unit overlaps the seat unit, and a first extended position, in which the backrest unit stands upright from the seat unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
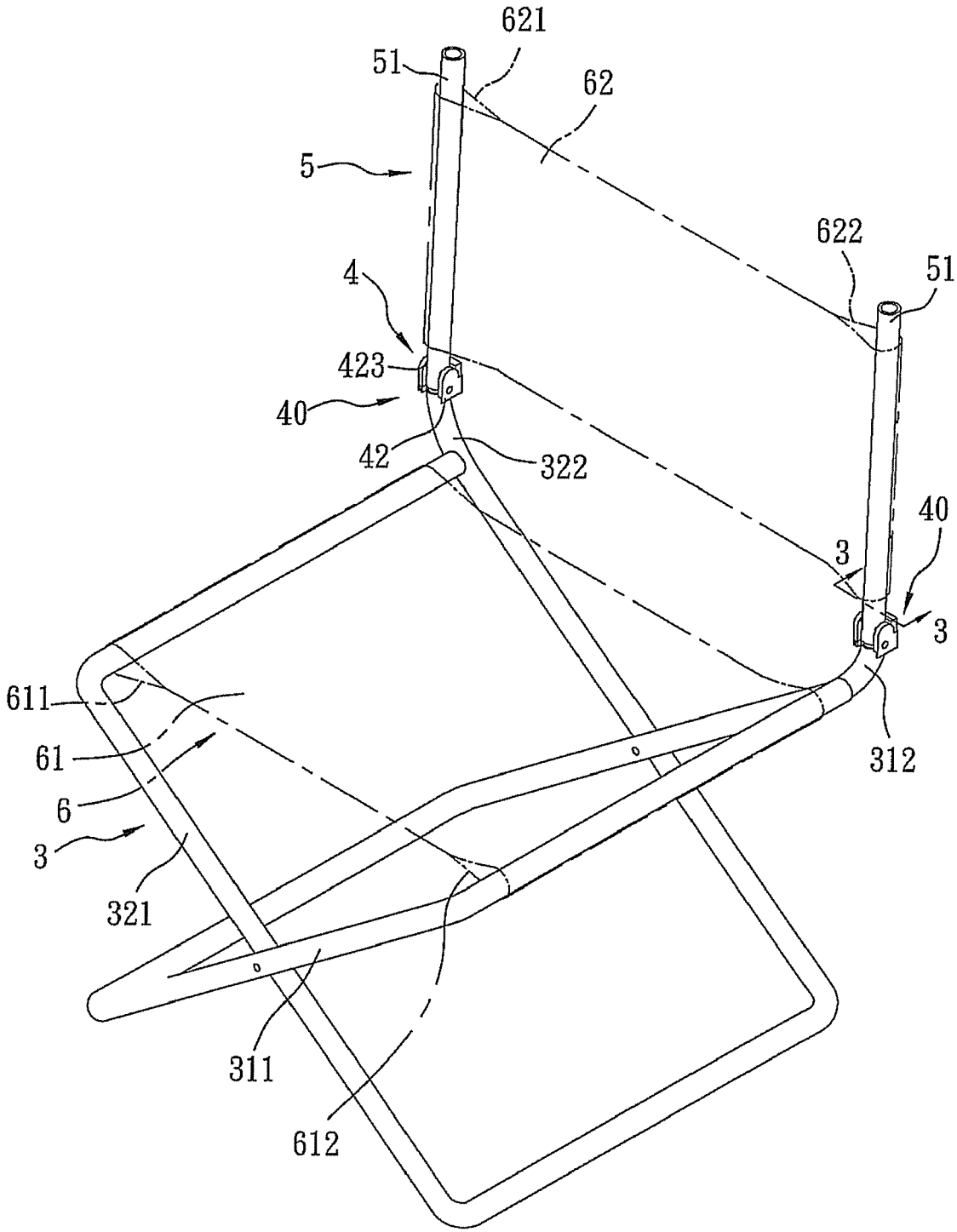
FIG. 1 is an assembled perspective view of the preferred embodiment of a foldable chair according to the invention, illustrating a state where a backrest unit is disposed at a first extended position, and a leg unit is disposed at a second extended position.
Figure 2:
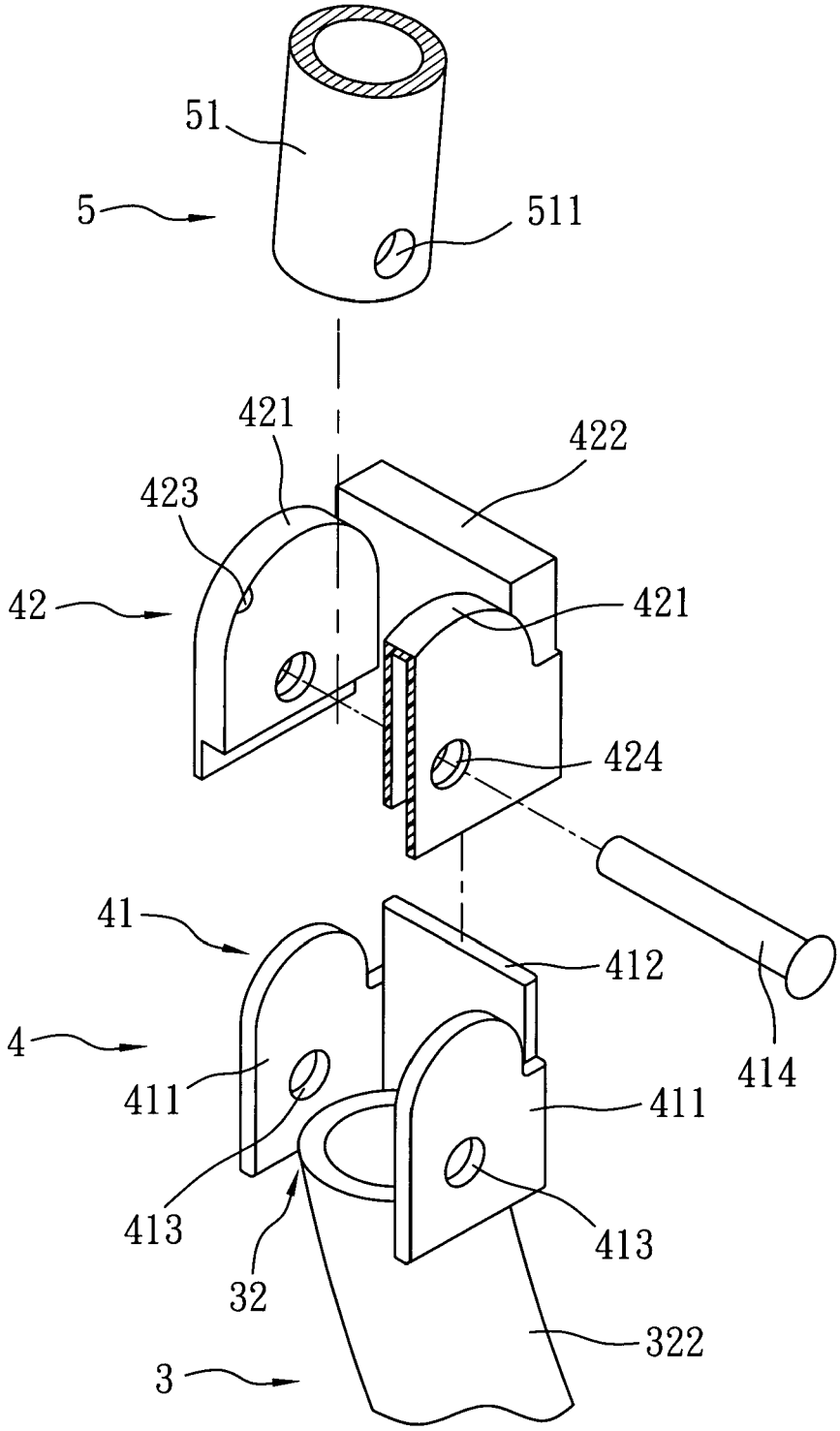
FIG. 2 is an exploded perspective view to illustrate how a backrest rod is pivoted to a leg frame through a pivot joint of the preferred embodiment.
Figure 3:
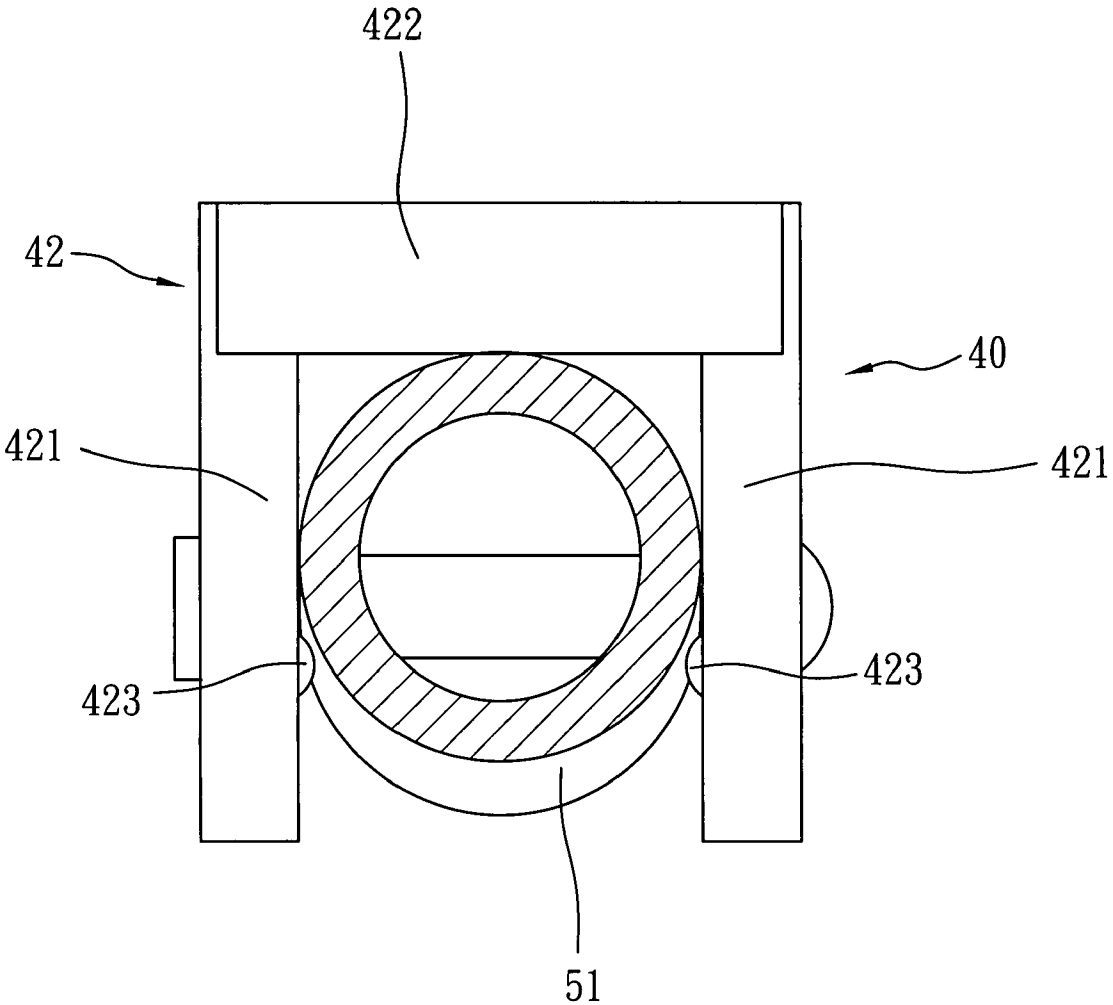
FIG. 3 is a sectional top view taken along line 3-3 in FIG. 1 to illustrate an assembled structure of the pivot joint and the backrest rod of the preferred embodiment when the backrest unit is disposed at the first extended position.

As shown in FIGS. 1, 2 and 3, the preferred embodiment of a foldable chair includes a leg unit 3, a seat unit 6 supported on the leg unit 3, a pivot unit 4 including two pivot joints 40 secured to the leg unit 3, and a backrest unit 5 including two opposite backrest rods 51 that are pivoted to the leg unit 3 through the pivot joints 40, respectively.

The leg unit 3 includes a first leg frame 311 that is rectangular in shape and that has a first rod extension 312 that extends upwardly therefrom, and a second leg frame 321 that is rectangular in shape and that has a second rod extension 322 that extends upwardly therefrom. The first and second leg frames 311, 312 are pivoted to each other so as to be rotatable relative to each other between a second folded position and a second extended position. The first and second leg frames 311, 321 crisscross each other when they are disposed at the second extended position, and overlap each other when they are disposed at the second folded position.

Each of the pivot joints 40 is secured to a respective one of the first and second rod extension 312, 322 of the first and second leg frames 311, 321, respectively, and includes a generally U-shaped bracket plate 41 and a pivot pin 414. Each of the U-shaped bracket plates 41 has two opposite arm portions 411 and a base portion 412 interconnecting the arm portions 411, and is formed with two opposite first pivot holes 413 respectively in the arm portions 411 for extension of the pivot pin 414 therethrough. Each of the pivot joints 40 further includes a bracket sleeve 42 that is sleeved on the U-shaped bracket plate 41. The bracket sleeve 42 has two arm portions 421 corresponding to the arm portions 411 of the bracket plate 41 and a base portion 422 corresponding to the base portion 412 of the bracket plate 41, and is formed with two opposite second pivot holes 424 in the arm portions 421 that correspond to the first pivot holes 413 in the U-shaped bracket plate 41 for extension of the pivot pin 414 therethrough, and two opposite retaining round protrusions 423 protruding from the arm portions 421, respectively. In this preferred embodiment, each of the U-shaped bracket plates 41 is made from metal and is welded to a respective one of the first and second extension rods 312, 322 of the first and second leg frames 311, 321 of the leg unit 3, respectively, and each of the bracket sleeves 42 is made from a plastic material.

Figure 4:
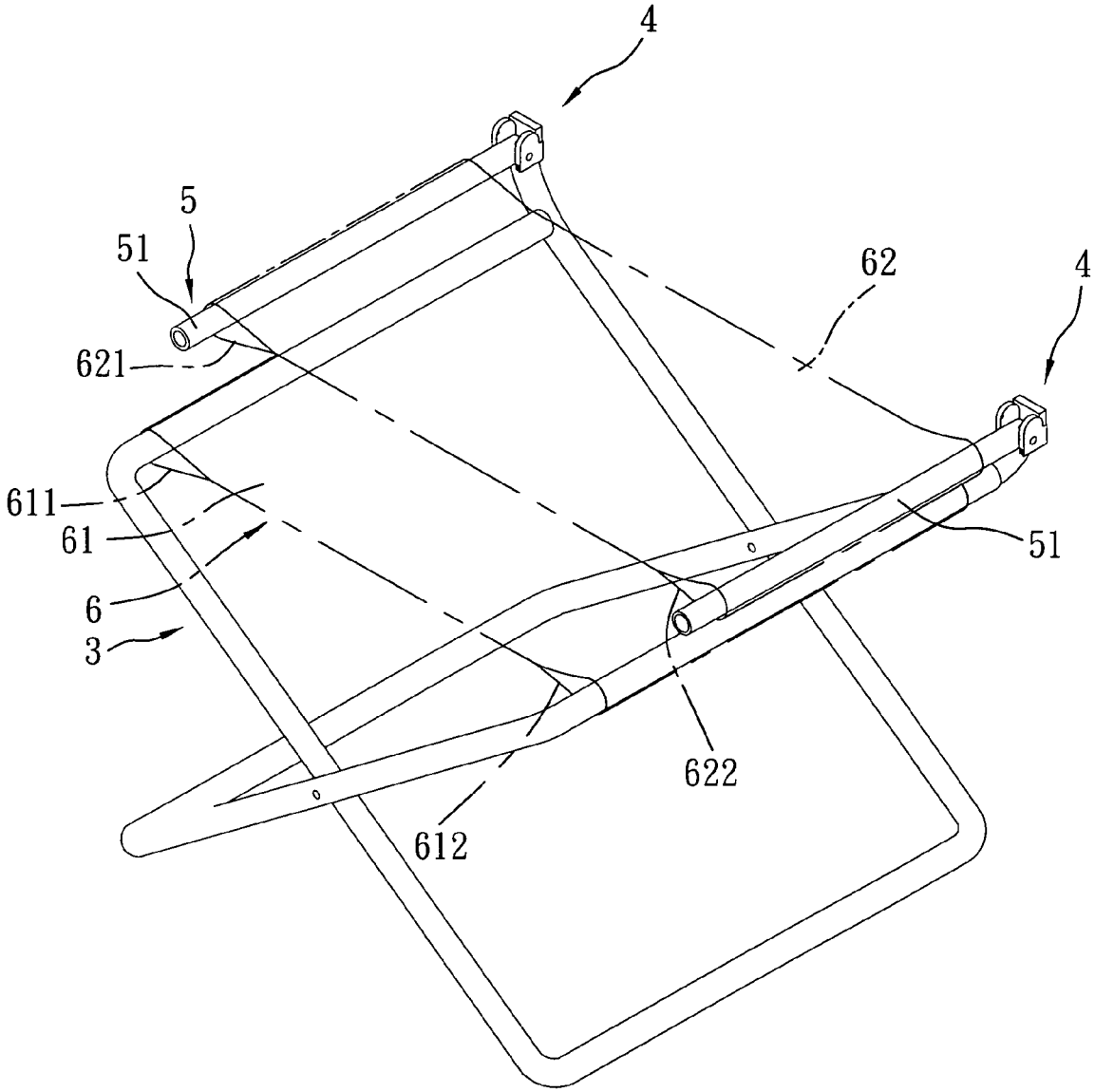
FIG. 4 is a perspective view illustrating the preferred embodiment in a state where the backrest unit is disposed at a first folded position.

Each of the backrest rods 51 is formed with two opposite third pivot holes 511, and has a portion sandwiched between the arm portions 411 of the U-shaped bracket plate 41 of a respective one of the pivot joints 40. For each assembly of one of the pivot joints 40 and a respective one of the backrest rods 51, the pivot pin 414 extends through the second pivot holes 424 in the bracket sleeve 42, the first pivot holes 413 in the U-shaped bracket plate 41, and the third pivot holes 511 in the backrest rod 51 so that the backrest unit 5 is rotatable relative to the leg unit 3 between a first folded position (see FIG. 4), in which the backrest unit 5 overlaps the seat unit 6, and a first extended position (see FIG. 1), in which the backrest unit 5 stands upright from the seat unit 6. Each of the backrest rods 51 is blocked by the base portion 412 of the U-shaped bracket plate 41 of a respective one of the pivot joints 40 when the backrest unit 5 is disposed at the first extended position, i.e., is blocked from undergoing further rearward pivoting movement. The retaining round protrusions 423 of the bracket sleeves 42 serve hold releasably a respective one of the backrest rods 51 when the backrest unit 5 is disposed at the first extended position, thereby retaining the backrest unit 5 at the first extended position.

The seat unit 6 includes a first flexible web 61 having two opposite end loops 611, 612 that are sleeved on the first and second leg frames 311, 321, respectively. The backrest unit 5 further includes a second flexible web 62 having two opposite end loops 621, 622 that are sleeved on the backrest rods 51, respectively.

Figure 5:
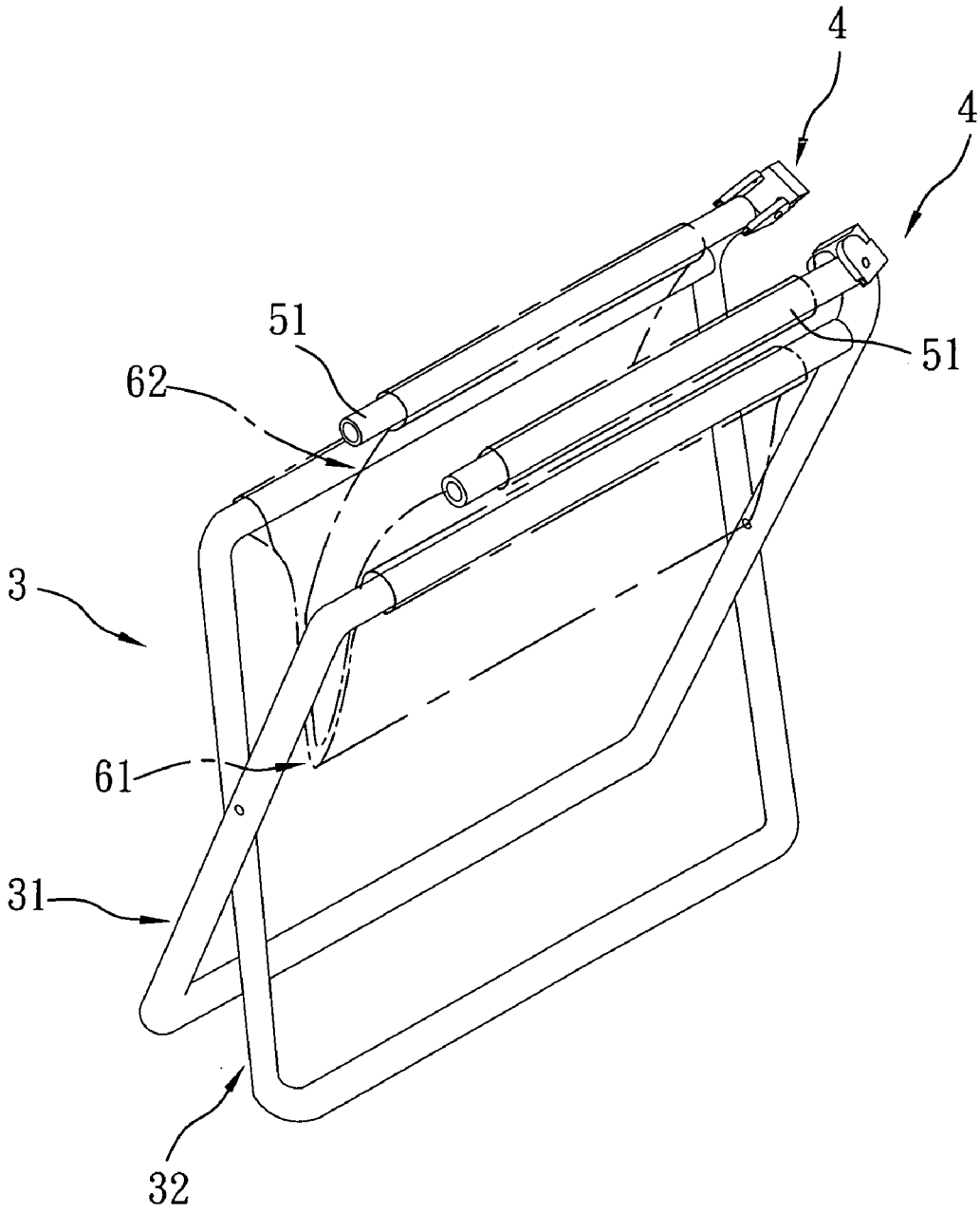
FIG. 5 is a perspective illustrating the preferred embodiment in another state where the backrest unit is disposed at the first folded position, and the leg unit is disposed at a second folded position.

Folding of the foldable chair of the preferred embodiment can be easily conducted. During folding, the backrest rods 51 are pushed downwardly to overlap the seat unit 6 (see FIG. 4), and the first and second leg frames 311, 321 are subsequently rotated relative to each other to the second folded position for fully folding the foldable chair (see FIG. 5). The size of the foldable chair is considerably reduced after being fully folded, thereby facilitating storage and transportation thereof. In addition, since the bracket sleeves 42 are made from the plastic material, wear in the backrest rods 51 of the backrest unit 5 and in the U-shaped bracket plates 41 during folding and unfolding operations is avoided.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable chair comprising:

a leg unit;

a seat unit supported on said leg unit;

a pivot unit including two pivot joints secured to said leg unit; and a backrest unit including two opposite backrest rods that are pivoted to said leg unit through said pivot joints, respectively, said backrest unit being rotatable relative to said leg unit between a first folded position, in which said backrest unit overlaps said seat unit, and a first extended position, in which said backrest unit stands upright from said seat unit, wherein each of said pivot joints includes a generally U-shaped bracket plate and a pivot pin, said U-shaped bracket plate having two opposite arm portions and a base portion interconnecting said arm portions, each of said backrest rods having a portion sandwiched between said arm portions of said U-shaped bracket plate of a respective one of said pivot joints, said pivot pin of each of said pivot joints extending through said arm portions of said U-shaped bracket plate of a respective one of said pivot joints and said portion of a respective one of said backrest rods, each of said backrest rods being blocked by said base portion of said U-shaped bracket plate of a respective one of said pivot joints when said backrest unit is disposed at the first extended position, and wherein each of said pivot joints further includes a bracket sleeve that is sleeved on said bracket plate of a respective one of said pivot joints, and that is formed with two opposite retaining round protrusions for holding releasably a respective one of said backrest rods when said backrest unit is disposed at the first extended position.

2. The foldable chair as claimed in claim 1, wherein said leg unit includes two leg frames that are pivoted to each other so as to be rotatable relative to each other between a second folded position and a second extended position, said leg frames crisscrossing each other when said leg frames are disposed at the second extended position, and overlapping each other when said leg frames are disposed at the second folded position, said pivot joints being secured to said leg frames, respectively.

3. The foldable chair as claimed in claim 2, wherein said seat unit includes a first flexible web having two opposite end loops that are sleeved on said leg frames, respectively.

4. The foldable chair as claimed in claim 3, wherein said backrest unit further includes a second flexible web having two opposite end loops that are sleeved on said backrest rods, respectively.

* * * * *